United States Patent [19]

Masumoto et al.

[11] Patent Number: 5,074,935

[45] Date of Patent: Dec. 24, 1991

[54] AMORPHOUS ALLOYS SUPERIOR IN MECHANICAL STRENGTH, CORROSION RESISTANCE AND FORMABILITY

[75] Inventors: Tsuyoshi Masumoto, 3-8-22, Kamisugi, Aoba-ku, Sendai-shi, Miyagi; Akihisa, Inoue, Sendai; Hitoshi Yamaguchi, Okaya; Kazuhiko Kita, Sendai; Hideki Takeda, Kawasaki, all of Japan

[73] Assignees: Tsuyoshi Masumoto, Sendai; Teikoku Piston Ring Co., Ltd., Tokyo; Yoshida Kogyo K.K., Chiyoda, all of Japan

[21] Appl. No.: 542,747

[22] Filed: Jun. 22, 1990

[30] Foreign Application Priority Data

Jul. 4, 1989 [JP] Japan ..... 1-171298

[51] Int. Cl.[5] ..... C22C 21/00

[52] U.S. Cl. ..... 148/403; 420/416; 420/590

[58] Field of Search ..... 148/403; 420/416, 590

[56] References Cited

U.S. PATENT DOCUMENTS

| | | | |
|---|---|---|---|
| 4,787,943 | 11/1988 | Mahajan et al. | 148/437 |
| 4,911,767 | 3/1990 | Masumoto et al. | 420/528 |
| 4,964,927 | 10/1990 | Siftlet et al. | 420/528 |

FOREIGN PATENT DOCUMENTS

| | | |
|---|---|---|
| 0136508 | 4/1985 | European Pat. Off. . |
| 0317710 | 5/1989 | European Pat. Off. . |
| 3524276 | 1/1986 | Fed. Rep. of Germany . |
| 62-30829 | 2/1987 | Japan . |
| 62-30840 | 2/1987 | Japan . |

*Primary Examiner*—Upendra Roy

*Attorney, Agent, or Firm*—Flynn, Thiel, Boutell & Tanis

[57] ABSTRACT

The present invention provides an amorphous alloy having superior mechanical strength, corrosion resistance for formability, at a relatively low cost. The amorphous alloy is a composition represented by the general formula: $Al_{100-x-y}M_xLn_y$ wherein M is at least one element selected from the group consisting of Ti, V, Cr, Mn, Fe, Co, Ni, Cu, Zr, Nb, Mo, Hf, Ta and W; Ln is at least one element selected from the group consisting of Y, La, Ce, Nd, Sm, Gd, Tb, Dy, Ho and Yb or misch metal (Mm) which is a combination of rare earth elements; and x and y are, in atomic percentages: $0<x\leqq 55$ and $30\leqq y\leqq 90$, preferably $0<x\leqq 40$ and $35\leqq y\leqq 80$, and more preferably $5<x\leqq 40$ and $35\leqq y\leqq 70$, with the proviso that $100-x-y\geqq 5$ the alloy having at least 50% (by volume) of an amorphous phase.

4 Claims, 6 Drawing Sheets

AMORPHOUS ALLOYS SUPERIOR IN MECHANICAL STRENGTH, CORROSION RESISTANCE AND FORMABILITY

BACKGROUND OF THE INVENTION

1. Field of the Invention

The present invention relates to amorphous alloys containing a rare earth element or elements and which have a high degree of hardness, strength, wear resistance, corrosion resistance and formability.

2. Description of the Prior Art

Heretofore, rare earth metals have been used as additives for iron-based alloys or the like, or used in the form of intermetallic compounds for magnetic material applications. However, no practical use of rare earth metal-based alloys has been known up to now. As a characteristic property of rare earth metals, they generally have a low tensile-strength of 200 to 300 MPa. When rare earth metals are used as intermetallic compounds, there is a problem of poor formability. Therefore, there has been a strong demand for rare earth metal-based alloys having high strength and superior formability.

Heretofore, when rare earth metals were used in rare earth metal-based alloys, the strength of the alloys is low. When rare earth metals are used in intermetallic compounds, an adequate formability can not be obtained. Therefore, the applications of these alloys have been limited to a narrow range, such as magnetic sintered materials and thin film materials.

SUMMARY OF THE INVENTION

It is accordingly an object of the present invention to improve the disadvantages of rare earth metal-based alloys, namely, low levels of strength and corrosion resistance and inferior formability of intermetallic compounds of rare earth metals, thereby enabling a greatly expanded use of rare earth metals as functional materials and resulting in a significantly reduced production cost.

The present invention provides an amorphous alloy having superior mechanical strength, corrosion resistance and formability, said amorphous alloy having a composition represented by the general formula:

$$Al_{100-x-y}M_xLn_y$$

wherein:

M is at least one element selected from the group consisting of Ti, V, Cr, Mn, Fe, Co, Ni, Cu, Zr, Nb, Mo, Hf, Ta and W;

Ln is at least one element selected from the group consisting of Y, La, Ce, Nd, Sm, Gd, Tb, Dy, Ho and Yb or misch metal (Mm) which is a combination of rare earth elements; and x and y are, in atomic percentages:

$0<x\leqq 55$ and $30\leqq y\leqq 90$, preferably $0<x\leqq 40$ and $35\leqq y\leqq 80$, and more preferably $5<x\leqq 40$ and $35\leqq y\leqq 70$, with the proviso that $100-x-y\leqq s$ the alloy having at least 50% (by volume) an amorphous phase.

DETAILED DESCRIPTION OF THE PREFERRED EMBODIMENTS

Figure 1:
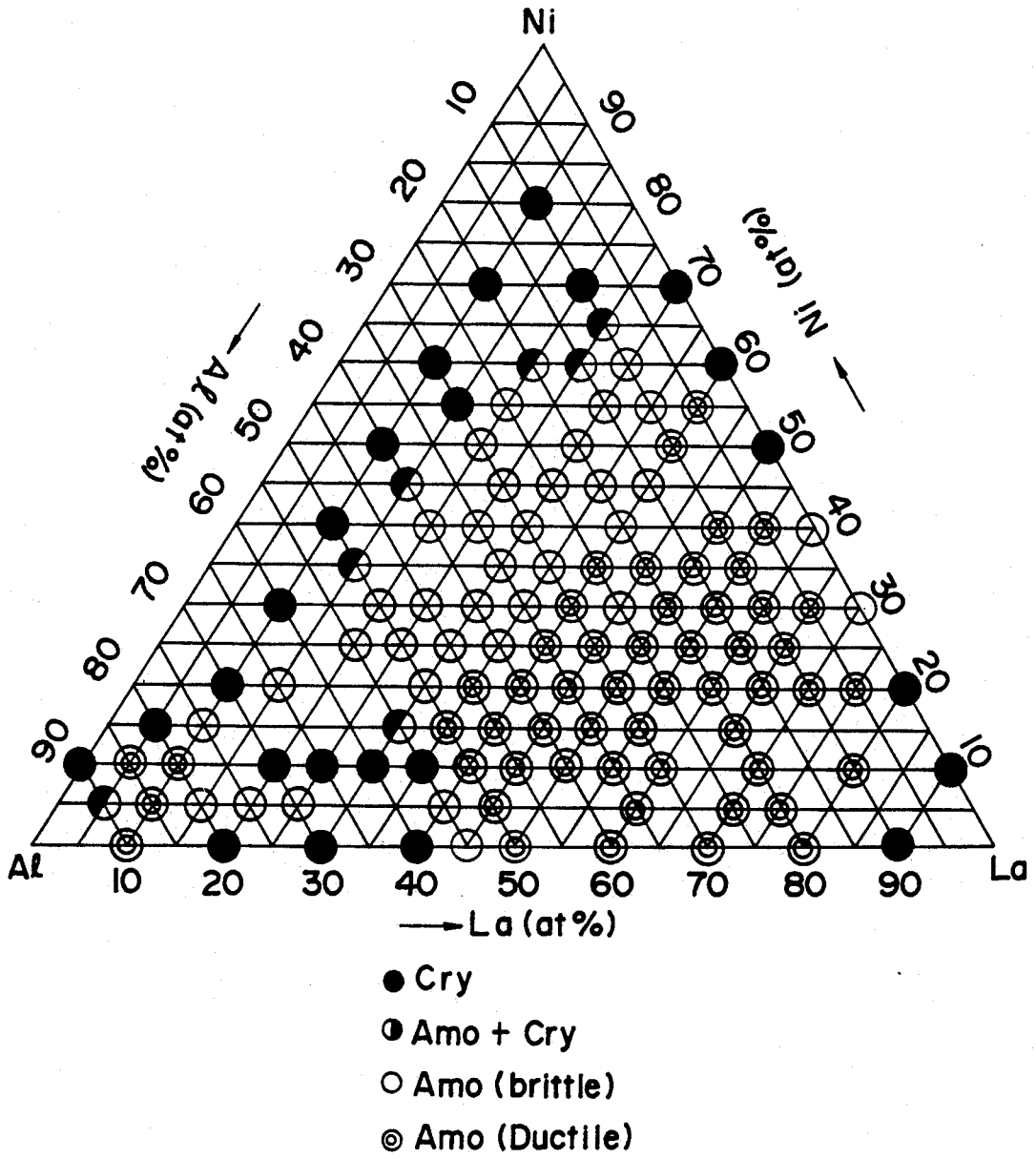
FIG. 1 is a ternary compositional diagram showing the structure of an example of Al-Ni-La system alloy thin ribbons according to the present invention.

The aluminum alloys of the present invention can be obtained by rapidly solidifying a melt of the alloy having the composition as specified above by means of a liquid quenching technique. The liquid quenching technique is a method for rapidly cooling a molten alloys particularly, single-roller melt-spinning technique, twin roller melt-spinning technique, in-rotating-water melt-spinning technique or the like are used as effective examples of such a technique. In these techniques, a cooling rate of about $10^4$ to $10^6$ K/sec can be obtained. In order to produce thin ribbon materials by the single-roller melt-spinning technique or twin roller melt-spinning technique, the molten alloy is ejected from the opening of a nozzle onto a roll of, for example, copper or steel, with a diameter of 30–3000 mm, which is rotating at a constant rate within the range of about 300–10000 rpm. In these techniques, various thin ribbon materials with a width of about 1–300 and a thickness of about 5–500 μm can readily be obtained. Alternatively, in Order to produce fine wire materials by the in-rotating-water melt-spinning technique, a jet of the molten alloy is directed, under application of a back pressure of argon gas through a nozzle into a liquid refrigerant layer having a depth of about 10 to 100 mm and which is retained by centrifugal force in a drum rotating at a rate of about 50 to 500 rpm. In such a manner, fine wire materials can be readily obtained. In this technique, the angle between the molten alloy ejecting from the nozzle and the liquid refrigerant surface is preferably in the range of about 60° to 90° and the ratio of the velocity of the ejected molten alloy to the velocity of the liquid refrigerant is preferably in the range of about 0.7 to 0.9.

Besides the above process, the alloy of the present invention can be also obtained in the form of thin film by a sputtering process. Further, a rapidly solidified powder of the alloy composition of the present invention can be obtained by various atomizing processes, for example, a high pressure gas atomizing process or spray process.

Whether the rapidly solidified alloys thus obtained are amorphous or not can be known by checking the presence of the characteristic halo pattern of an amorphous structure by using an ordinary X-ray diffraction method. The amorphous structure is transformed into a crystalline structure by heating to a certain temperature (called "crystallization temperature") or higher temperatures.

In the aluminum alloys of the present invention represented by the above general formula, "x" is limited to the range of more than 0 (not including 0) to 55 atomic% and "y" is limited to the range of 30 to 90 atomic %. The reason for such limitations is that when "x" and "y" stray from the above specified ranges and certain ranges; it is difficult to form an amorphous phase in the resulting alloys and the intended alloys having at least 50 volume % of an amorphous phase can not be obtained by industrial cooling techniques using the above-mentioned liquid quenching techniques, etc. In the above specified compositional range, the alloys of the present invention exhibit advantageous properties, such as high hardness, high strength and high corrosion resistance which are characteristic of amorphous alloys. The certain ranges set forth above have been disclosed in Assignee's U.S. Pat. No. 4,911,767, issued Mar. 27, 1990 (Japanese Patent Application No. 63-61877) and Assignee's prior U.S. Pat. application Ser. No. 345 677, filed Apr. 28, 1989 (Japanese Patent Application No. 63-103812) and, thus, these ranges are excluded from the scope of Claims of the present invention in order to avoid any compositional overlap.

When the values of "x" and "y" are: $0<x\leqq 40$ atomic % and $35\leqq y\leqq 80$ %, the resulting amorphous alloys, besides having the various advantageous properties characteristic of amorphous alloys, exhibit a superior ductility sufficient to permit a bending of 180° in the form of ribbons. Such a high degree of ductility is desirable in improving the physical properties, e.g., impact-resistance and elongation, of the materials.

Particularly, in the ranges of $5<x\leqq 40$ atomic % and $35\leqq y\leqq 70$ atomic %, the above advantageous properties can be ensured at higher levels and, further, a wider glass transition range (Tx-Tg) can be achieved. In the glass transition range, the alloy material is in a supercooled liquid state and, exhibits a very superior formability which permits a large degree of deformation under application of a small stress. Such advantageous properties make the resulting alloy materials very suitable for applications such as parts having complicated shapes or articles prepared by processing operations requiring a high degree of plastic flow.

The "M" element is at least one element selected from the group consisting of Ti, V, Cr, Mn, Fe, Co, Ni, Cu, Zr, Nb, Mo, Hf, Ta and W. These elements in coexistence with Al not only improve the capability to form an amorphous phase, but also provides an increased crystallization temperature in combination with improved hardness and strength.

The "Ln" element is at least one element selected from the group consisting of rare earth elements (Y and elements of atomic numbers of 57 to 70) and the rare earth element or elements may be replaced by Mm which is a mixture of rare earth elements. Mm used herein consists of 40–50% Ce and to 25% La, the balance being other rare earth elements and impurities (Mg, Al, Si, Fe, etc) in acceptable amounts. The rare earth elements represented by "Ln" can be replaced with Mm in a ratio of about 1:1 (by atomic percent) in the formation of the amorphous phase contemplated by the present invention and Mm provides a greatly economical advantage as a practical source material of the alloying element "Ln" because of its cheap price.

The alloys of the present invention exhibit a supercooled liquid state (glass transition range) in a very wide temperature range and some compositions exhibit a glass transition temperature range of 60 K or more. In the temperature range of the supercooled liquid state, plastic deformation can be performed under a low pressure with ease and without any restriction. Therefore, powder or thin ribbons can be easily consolidated by conventional processing techniques, for example, extrusion, rolling, forging or hot pressing. Further, due to the same reason, the alloy powder of the present invention in a mixture with other alloy powder can be also easily compacted and molded into composite articles at a low temperature and low pressure. Further, since the amorphous ribbons of the invention alloys produced by liquid quenching techniques, have a superior ductility, they can be subjected to a bending of 180° in a wide compositional range, without cracking or separation from a substrate.

Appropriate selection of Fe, Co, etc., as the "M" element., and Sm, Gd, etc as the "Ln" element provides various kinds of magnetic amorphous materials in a bulk form or thin film form. Also, consolidated amorphous materials can be converted to crystalline materials by retaining them at a crystallization temperature or higher temperatures for an appropriate period of time.

Now, the present invention will be more specifically described with reference to the following examples.

EXAMPLE 1

Figure 6:
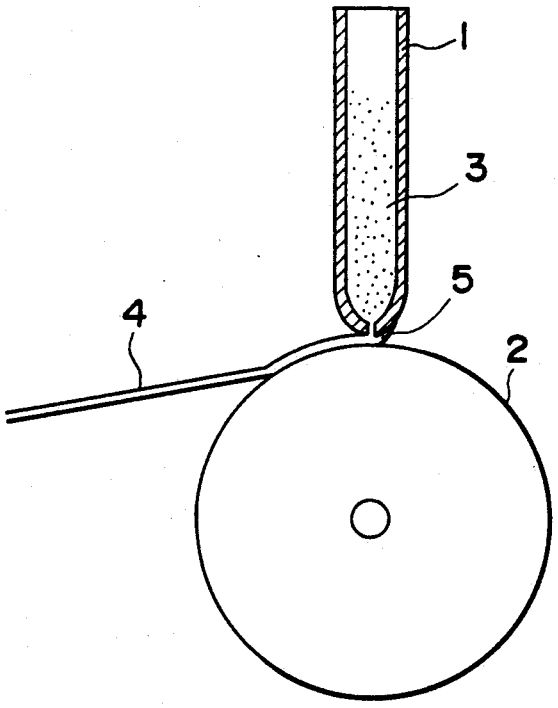
FIG. 6 is an illustration showing an example of the preparation process according to the present invention.

A molten alloy 3 having a predetermined alloy composition was prepared by a high-frequency induction melting process and was charged into a quartz tube 1 having a small opening 5 with a diameter of 0.5 mm at the tip thereof, as shown in FIG. 6. After heating and melting the alloy 3, the quartz tube 1 was disposed right above a copper roll 2 having a diameter of 200 mm. Then, the molten alloy 3 contained in the quartz tube 1 was ejected from the small opening 5 of the quartz tube 1 under application of an argon gas pressure of 0.7 $kg/cm^2$ and brought into contact with the surface of the roll 2 rapidly rotating at a rate of 5,000 rpm. The molten alloy 3 was rapidly solidified and an alloy thin ribbon 4 was obtained.

According to the processing conditions as described above, there were obtained thin ribbons of ternary alloys, as shown in a compositional diagram of an Al-Ni-La system. In the compositional diagram, the percentages of each element are recorded at a interval of 5 atomic %. X-ray diffraction analysis for the resulting thin ribbons showed that an amorphous phase was obtained in a°very wide compositional range. In FIG. 1, the mark "◎ indicates an amorphous phase and a ductility sufficient to permit a bending of 180° without fracture, the mark "○" indicates an amorphous phase and brittleness, the mark "◑" indicates a mixed phase of an amorphous phase and a cryltalline phase, and the mark "●" indicates a crystalline phase.

FIGS. 2, 3, 4 and 5 show the measurement results of the hardness (Hv), glass transition temperature (Tg), crystallization temperature (Tx) and glass transition range (Tx-Tg), respectively, for each thin ribbon specimen.

Figure 2:
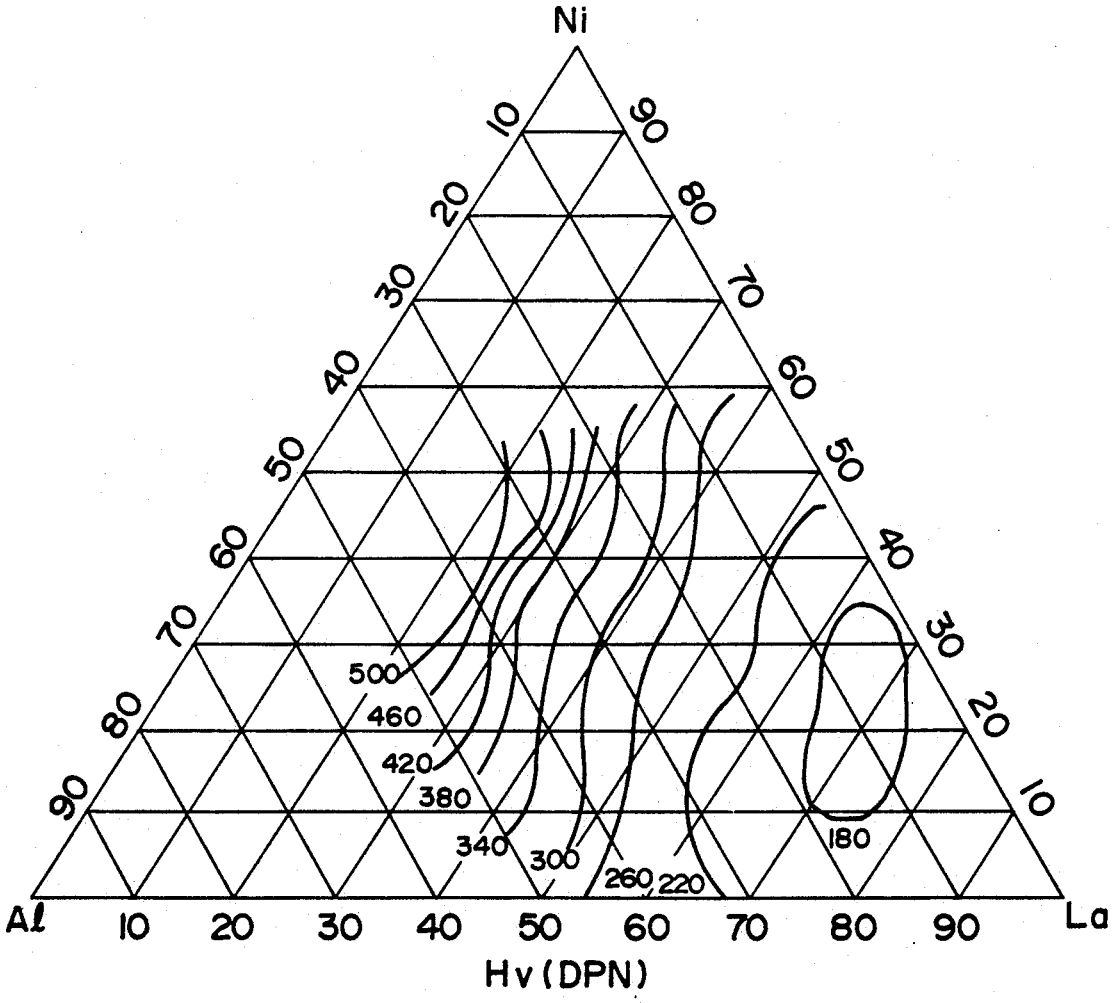
FIG. 2 is a diagram showing the hardness of each test specimen.

FIG. 2 indicates the distribution of the hardness of thin ribbons falling within the amorphous phase region of the compositions shown in FIG. 1. The alloys of the present invention have a high level of hardness (Hv) of 180 to 500 (DPN) and the hardness is variable depending only on the variation of the content of La regardless of the variations of the contents of Al and Ni. More specifically, when the La content is 30 atomic %, the Hv is on the order of 400 to 500 (DPN) and, thereafter, the hardness decreases with an increase in La content. The hardness Hv shows a minimum value of 180 (DPN) when the La content is 70 atomic % and, thereafter, it sightly increases with Aa increase in La content.

Figure 3:
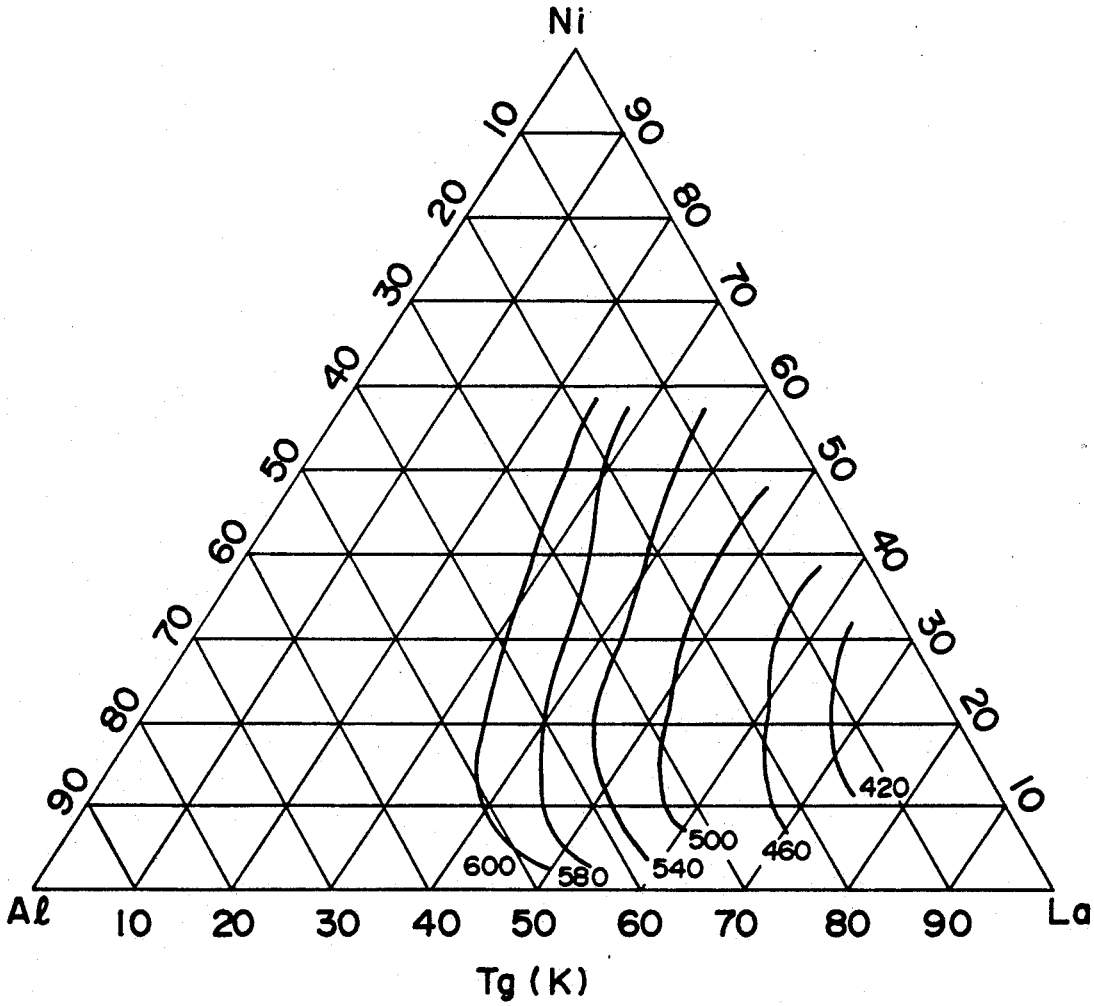
FIG. 3 is a diagram showing the glass transition temperature of each test specimen.

FIG. 3 shows the change in Tg (glass transition temperature) of the amorphous phase region shown in FIG. 1 and the Tg change greatly depends on the variation in La content, as in the hardness change. More specifically, when the La content is 30 atomic %, the Tg value is 600 K and, thereafter, the Tg decreases with an increase in La content and reaches 420K at a La content of 70 atomic %. La contents falling outside the above range provide no Tg.

Figure 4:
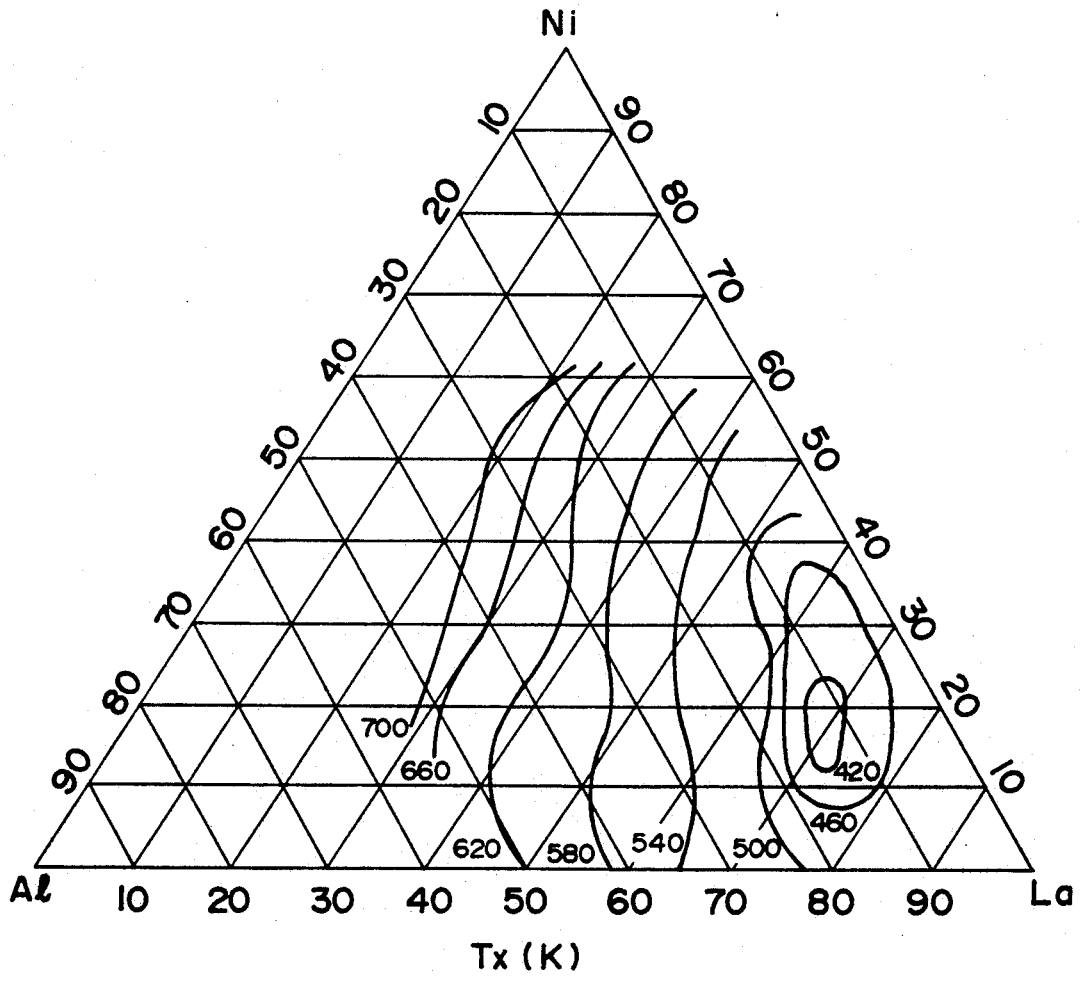
FIG. 4 is a diagram showing glass crystallization temperature of each test specimen.

FIG. 4 illustrates the variations in Tx (crystallization temperature) of thin ribbons falling within the amorphous phase forming region shown in FIG. 1 and shows a strong dependence on the content of La as referred to FIGS. 2 and 3. More specifically, a La content of 30 atomic % provides a high Tx level of 660 K and, thereafter, the Tx decreases with an increase in La content. A La content of 70 atomic % provides a minimum Tx value of 420 K and, thereafter, Tx values slightly increase.

Figure 5:
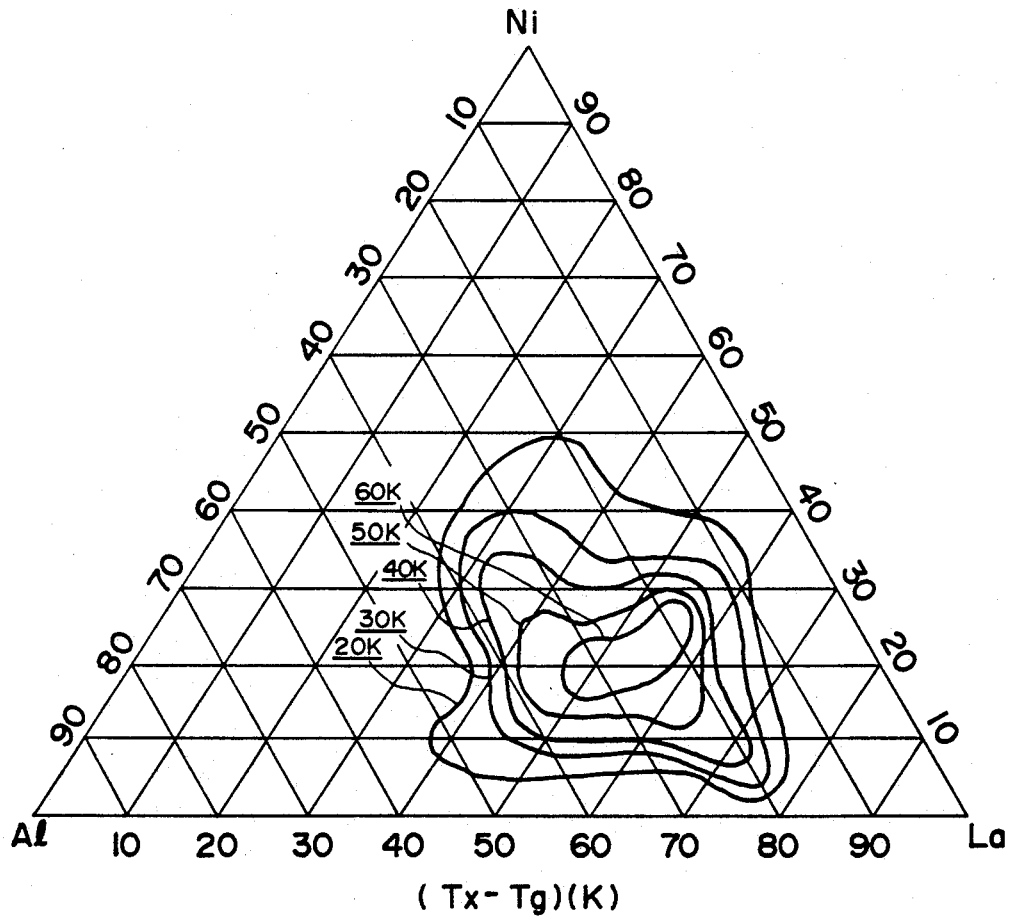
FIG. 5 is a diagram showing a glass transition range.

FIG. 5 is a diagram plotting the difference (Tx-Tg) between Tg and Tx' which are shown in FIGS. 3 and 4, respectively, and the diagram shows a temperature range of the glass transition range. In the diagram, the wider the temperature range, the more stable the amorphous phase becomes. Using such a temperature range, processing and forming operations can be conducted in a wider range with respect to operation temperature and time while retaining an amorphous phase and various operation conditions can be easily controlled. The value of 60 K at a La content of 50 atomic % as shown in FIG. 5 means an the alloy having a stable amorphous phase and a superior processability.

Further, Table 1 shows the results of tensile strength measurement for five test specimens included within the compositional range which provides an amorphous phase, together with the hardness, glass transition temperature and crystallization temperature. All of the tested specimens showed high strength levels of not less than 500 MPa and have been found to be high strength materials.

TABLE 1

| Alloy composition | δf(Mpa) | Hv(DPN) | Tg(K) | Tx(K) |
|---|---|---|---|---|
| $La_{45}Al_{45}Ni_{10}$ | 792 | 330 | 580 | 610 |
| $La_{45}Al_{35}Ni_{20}$ | 716 | 287 | 537 | 594 |
| $La_{50}Al_{35}Ni_{15}$ | 685 | 285 | 523 | 582 |
| $La_{50}Al_{30}Ni_{20}$ | 713 | 305 | 510 | 578 |
| $La_{55}Al_{25}Ni_{20}$ | 512 | 221 | 478 | 542 |

As set forth above, the alloys of the present invention have an amorphous phase in a wide compositional range and have a glass transition region in a large portion of the compositional range. Therefore, it can be seen that the alloys of the present invention are materials with good formability combined with high strength.

EXAMPLE 2

Amorphous alloy thin ribbons having 21 different alloy compositions as shown in Table 2 were prepared in the same manner as described in Example 1 and measured for tensile strength, hardness, glass transition temperature and crystallization temperature. It has been found that all of the test specimen are in an amorphous state and are high strength, thermally stable materials having a tensile strength of not less than 500 MPa, Hv of not less than 200 (DPN) and a crystallization temperature of not lower than 500 K.

TABLE 2

| Alloy Composition | δf(MPa) | Hv(DPN) | Tg(K) | Tx(K) |
|---|---|---|---|---|
| 1. $Al_{45}Fe_{10}La_{45}$ | — | 573 | — | — |
| 2. $Al_{30}Fe_{20}Ce_{50}$ | 813 | 330 | 598 | 612 |
| 3. $Al_{15}Fe_{25}Sm_{60}$ | 615 | 316 | 523 | 560 |

TABLE 2-continued

| Alloy Composition | δf(MPa) | Hv(DPN) | Tg(K) | Tx(K) |
|---|---|---|---|---|
| 4. $Al_{20}Cu_{15}Co_{15}La_{50}$ | — | 385 | 530 | 585 |
| 5. $Al_{35}Cu_{10}Mm_{55}$ | 565 | 254 | 545 | 576 |
| 6. $Al_{25}Ni_{5}Hf_{10}Mm_{60}$ | 512 | 230 | 498 | 542 |
| 7. $Al_{35}Ni_{10}Ti_{5}Mm_{50}$ | — | 396 | 520 | 545 |
| 8. $Al_{35}Ni_{10}V_{10}Mm_{45}$ | 726 | 303 | 541 | 585 |
| 9. $Al_{30}Ni_{10}Zr_{10}Mm_{50}$ | 610 | 293 | 565 | 598 |
| 10. $Al_{35}Ni_{10}V_{10}Mm_{45}$ | 726 | 303 | 541 | 585 |
| 11. $Al_{50}Fe_{10}Nb_{5}Mm_{35}$ | — | 470 | 615 | 632 |
| 12. $Al_{30}Fe_{10}Mn_{5}Mm_{55}$ | — | 295 | 516 | 565 |
| 13. $Al_{10}Ni_{15}La_{65}Y_{10}$ | 503 | 211 | 483 | 545 |
| 14. $Al_{25}Ni_{15}Cr_{10}Mm_{50}$ | 785 | 355 | 560 | 578 |
| 15. $Al_{30}Fe_{10}Mn_{10}Mm_{50}$ | 750 | 341 | 532 | 551 |
| 16. $Al_{15}Fe_{10}Mo_{10}Mm_{65}$ | 678 | 311 | 538 | 552 |
| 17. $Al_{40}Ni_{5}Zr_{10}Mm_{45}$ | 812 | 394 | 487 | 516 |
| 18. $Al_{15}Ni_{5}Nb_{10}Mm_{70}$ | 693 | 331 | 478 | 502 |
| 19. $Al_{15}Ni_{10}Ta_{5}Mm_{70}$ | 705 | 364 | 497 | 509 |
| 20. $Al_{30}Fe_{10}W_{5}Mm_{55}$ | 783 | 389 | 563 | 592 |
| 21. $Al_{30}Ni_{10}Hf_{5}Mm_{55}$ | 752 | 341 | 543 | 565 |

EXAMPLE 3

A further amorphous ribbon was prepared from an alloy having the composition $Al_{35}Ni_{15}La_{50}$ in the same way as described in Example 1 and was comminuted into a powder having a mean particle size of about 20 μm using a rotary mill which has been heretofore known as a comminution device. The comminuted powder was loaded into a metal mold and compression-molded under a pressure of 20 kg/mm$^2$ at 550 K for a period of 20 minutes in an argon gas atmosphere to give a consolidated bulk material of 10 mm in diameter and 8 mm in height. There was obtained a high strength consolidated bulk material having a density of at least 99% relative to the theoretical density and no pores or voids were detected under an optical microscope. The consolidated material was subjected to X-ray diffraction. It was confirmed that an amorphous phase was retained in the consolidated bulk materials.

EXAMPLE 4

An amorphous alloy powder of $AL_{35}Ni_{15}La_{50}$ obtained in the same waY as set forth in Example 3 was added in an amount of 5% by weight to alumina powder having a mean particle size of 3 μm and was hot pressed under the same conditions as in Example 3 to obtain a composite bulk material. The bulk material was investigated by an X-ray microanalyzer and it was found that it had an uniform structure in which the alumina powder was surrounded with an alloy thin layer (1 to 2 μ) with strong adhesion.

As set forth above, the present invention provides novel amorphous alloys which have an advantageous combination of high hardness, high strength, high wear-resistance and superior corrosion resistance and can be subjected to a large degree of bending operation, at a relatively low cost.

What is claimed is:

1. An amorphous alloy superior in mechanical strength, corrosion resistance and formability, said alloy having a composition represented by the general formula:

$$Al_{100-x-y}M_xLn_y$$

wherein:

M is at least one element selected from the group consisting of Ti, V, Cr, Mn, Fe, Co, Ni, Cu, Zr, Nb, Mo, Hf, Ta and W;

Ln is at least one element selected from the group consisting of Y, La, Ce, Nd, Sm, Gd, Tb, Dy, Ho and Yb or Mm, Mm consisting of 40–50% Ce, 20–25% La and the balance being other rare earth elements; and x and y are atomic percentages falling within the following ranges: $0<x\leqq 55$ and $30\leqq y\leqq 90$, with the proviso that $100-x-y\geqq 5$, said amorphous alloy having at least 50% by volume of an amorphous phase.

2. An amorphous alloy as claimed in claim 1 in which said x and y are atomic percentages falling within the ranges:

$$0<x\leqq 40 \text{ and } 35\leqq y\leqq 80.$$

3. An amorphous alloy as claimed in claim 1 in which said x and y are atomic percentages falling within the ranges:

$$5<x\leqq 40 \text{ and } 35\leqq y\leqq 70.$$

4. An amorphous alloy superior in mechanical strength, corrosion resistance and formability, said alloy having a composition represented by the general formula:

$$Al_{100-x-y}M_xLn_y$$

wherein:

M is at least one element selected from the group consisting of Ti, V, Cr, Mn, Fe, Co, Ni, Cu, Zr, Nb, Mo, Hf, Ta and W;

Ln is at least one element selected from the group consisting of Y, La, Ce, Nd, Sm, Gd, Tb, Dy, Ho and Yb; and x and y are atomic percentages falling within the following ranges:

$0<x\leqq 55$ and $30\leqq y\leqq 90$, with the proviso that $100-x-y\geqq 5$, said amorphous alloy having at least 50% by volume of an amorphous phase.

* * * * *